US005458044A

United States Patent [19]

Delbos

[11] Patent Number: 5,458,044

[45] Date of Patent: Oct. 17, 1995

[54] SYSTEM FOR STORING AND FEEDING PROPELLANT CHARGES

[75] Inventor: François Delbos, Bourges, France

[73] Assignee: Giat Industries, Versailles, France

[21] Appl. No.: 200,696

[22] Filed: Feb. 23, 1994

[30] Foreign Application Priority Data

Mar. 12, 1993 [FR] France ..... 93 02893

[51] Int. Cl.[6] ..... F41A 9/09

[52] U.S. Cl. ..... 89/33.1; 89/34; 89/45

[58] Field of Search ..... 89/33.1, 34, 36.13, 89/33.01, 45, 46

[56] References Cited

U.S. PATENT DOCUMENTS

| | | | |
|---|---|---|---|
| 3,021,762 | 2/1962 | Söderqvist | 89/33.1 |
| 3,045,553 | 7/1962 | Mösle | 89/33.1 |
| 3,306,165 | 2/1967 | Christiansson | 89/33.1 |
| 3,331,281 | 7/1967 | Jäfvert | 89/33.1 |
| 3,747,469 | 7/1973 | Ashley et al. | 89/34 |
| 4,092,900 | 6/1978 | Hottinger et al. | 89/34 |
| 5,107,751 | 4/1992 | Grabner | 89/34 |
| 5,341,720 | 8/1994 | Franzén et al. | 89/45 |

*Primary Examiner*—Charles T. Jordan
*Attorney, Agent, or Firm*—Oliff & Berridge

[57] ABSTRACT

A system for storing and feeding propellant charges that are intended to be inserted into the chamber of the barrel of a medium- or large-caliber weapon of an armored vehicle such as a tank for example, contains a storage part including a magazine divided into m tiers each divided into n rows, each containing p individual charges of the modular type, and a feed part having a transfer device. The transfer device includes an elevator located opposite one face or front face of the magazine to receive individual charges and to transport them to a first tier of the elevator, a first device to insert individual charges into the elevator from each tier of the magazine, and a second device to remove individual charges from the first tier of the elevator and to transport a given number of the charges to a loading carrier.

26 Claims, 4 Drawing Sheets

FIG. 4
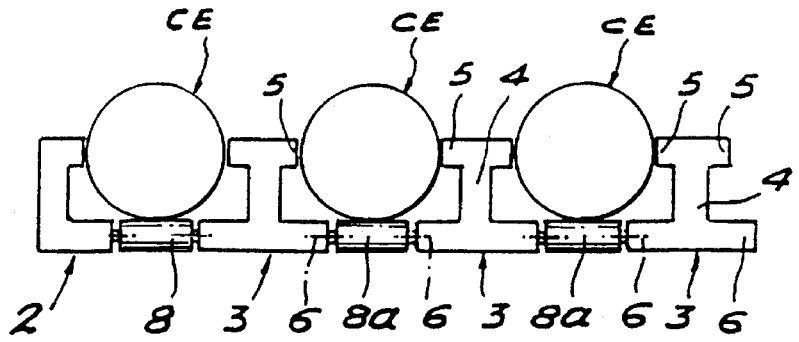
FIG. 5
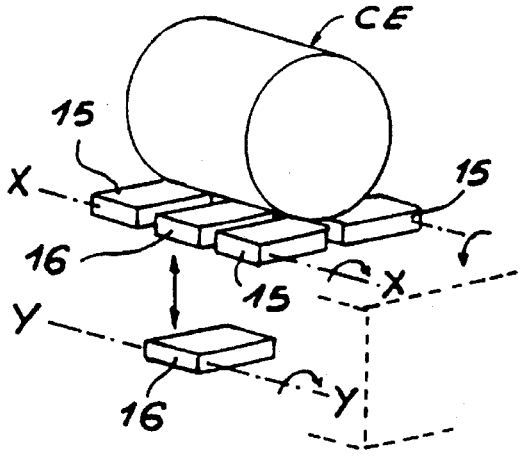
FIG. 6
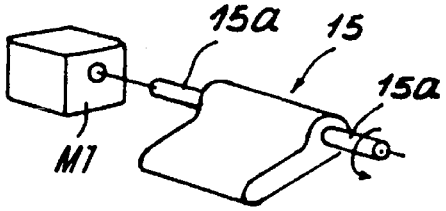
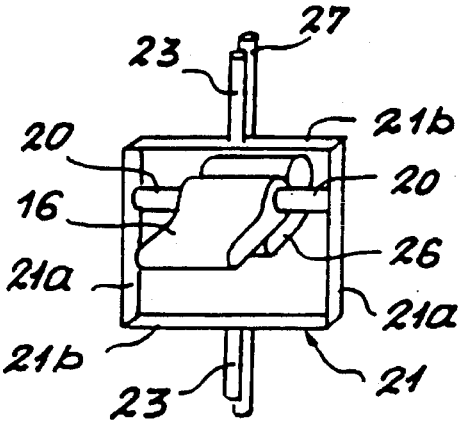
FIG. 7
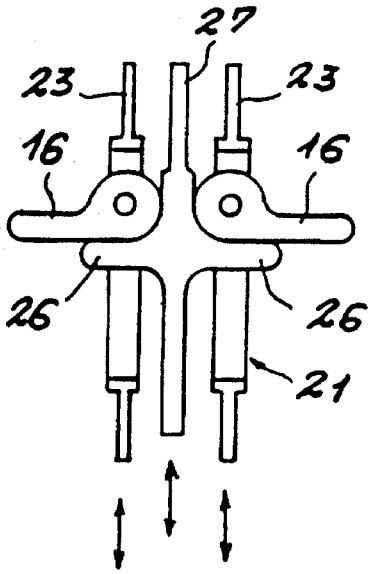
FIG. 8

SYSTEM FOR STORING AND FEEDING PROPELLANT CHARGES

BACKGROUND OF THE INVENTION

The present invention relates to a system for storing and feeding propellant charges that are intended to be inserted into the chamber of the barrel of a medium- or large-caliber weapon of an armored vehicle such as a tank for example, of the type having a storage part including a magazine and a feed part including a device for transferring the charges from the magazine to a loading carrier.

In general, several types of munitions are encountered, including those having a projectile and a propellant charge that are inserted in succession into the chamber of the barrel. For some of these munitions, the propellant charge includes a combustible envelope, of cylindrical shape and constant length, which contains bags of propellant powder in a number that varies according to the firing conditions envisaged and the type of projectile to be fired.

Such charges are stored in a magazine from which they are removed one by one to be routed to the barrel chamber. These removal and routing operations can be manual or executed by a semi-automatic or automatic operating transfer device.

In the case of an armored vehicle such as a tank, the charge storage magazine is generally built into the turret, which necessarily limits its size in view of the small space available inside a turret.

SUMMARY OF THE INVENTION

A goal of the invention is to design an improved system for storing and feeding propellant charges that is compatible with the available space in a tank turret for example, while increasing the storage capacity of the magazine and advantageously providing an automatic operating transfer device.

For this purpose, the invention proposes a storage and feed system of the aforesaid type, wherein the magazine is divided into m tiers each divided into n rows each containing p individual charges of the modular type, and wherein the transfer device includes:

- an elevator located opposite one face or a front face of the magazine to receive individual charges contained in the magazine and to transport them to a first tier of the elevator,
- a first device to insert the individual charges into the elevator from each tier of the magazine, and
- a second device to remove the individual charges from the first tier of the elevator and transport a given number thereof to the loading carrier to constitute a propellant charge designed to be routed to the barrel chamber of the weapon.

In general, the individual charges are identical, namely of the same cross section and same length, and the propellant charge necessary for firing a projectile is composed of a given number of these individual charges. As an inevitable result, there is an increase in the storage capacity of the magazine by comparison with a magazine of the same volume, storing charges of constant length but each containing a quantity of propellant powder that varies according to the type of projectile to be fired and the firing conditions.

BRIEF DESCRIPTION OF DRAWINGS

Other advantages, characteristics, and details of the invention will emerge from the following explanatory description referred to the attached drawings, provided solely as examples, wherein:

FIG. 4 is a partial end view of one tier of the magazine, FIG. 5 is a perspective view illustrating the operating principle of the first and second devices located in each compartment of one tier of the elevator, to receive one individual charge from the magazine and then to transfer it to a compartment of the elevator tier below, respectively, FIG. 6 is a perspective view of the first device for receiving an individual charge in one compartment of the elevator, FIG. 7 is a perspective view of the second device located in each compartment of the elevator to transfer a charge from one tier to the elevator tier below, FIG. 8 is a schematic view to illustrate the control device of the second device shown in FIG. 7, and FIGS. 9*a* and 9*b* are schematic views to illustrate the operation of the elevator to lower individual charges down to the first tier of the elevator.

DETAILED DESCRIPTION OF PREFERRED EMBODIMENTS

Figure 1:
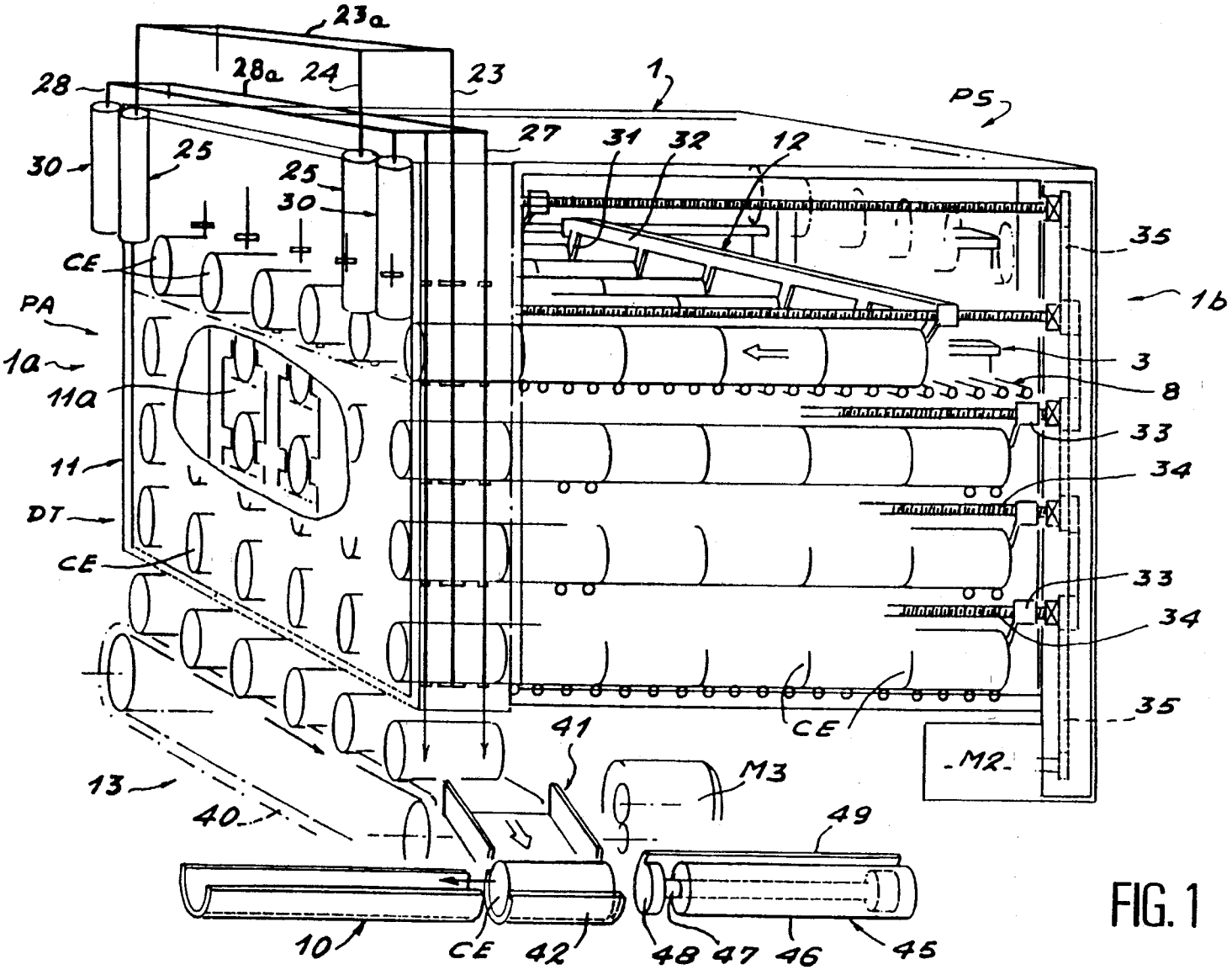
FIG. 1 is a partial and schematic perspective view of a propellant charge storage and feed system according to the invention, which system includes a magazine and an elevator.
Figure 2:
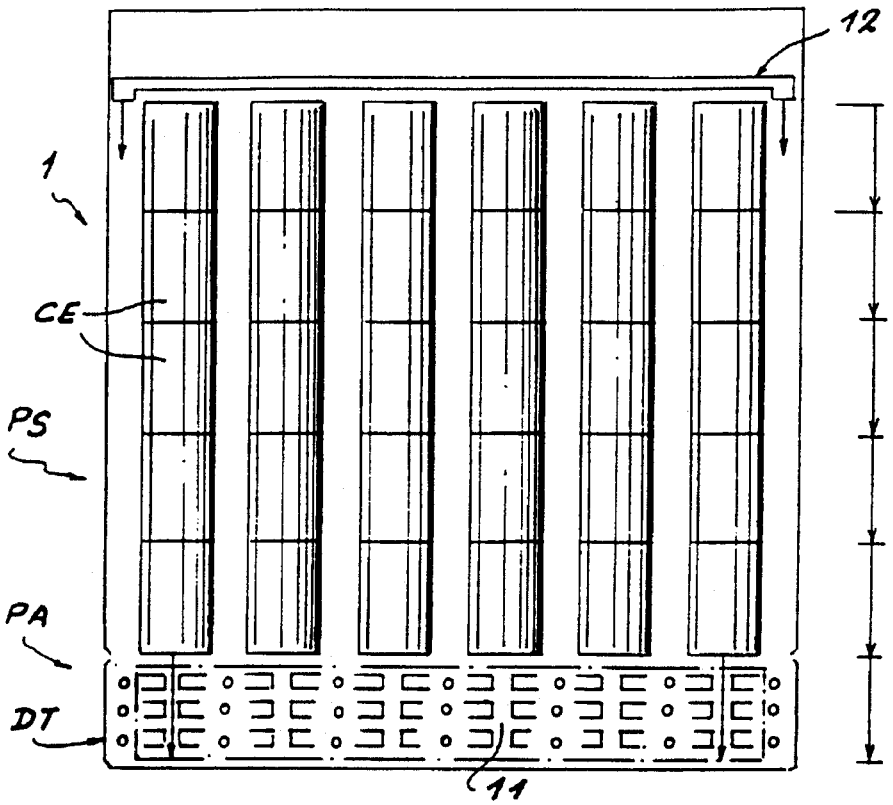
FIG. 2 is a schematic view from above of the storage and feed system as shown in FIG. 1.

According to one characteristic of the invention, the elevator has tiers, and each of at least (m−1) of these tiers is divided into the same number of compartments as there are rows in one tier of the magazine. Each compartment is located opposite one row of the magazine and is shaped to receive at least one individual charge.

According to another characteristic of the elevator, each compartment of the (m−1) tiers includes a first device for receiving and holding one individual charge coming either from the associated row of the same tier of the magazine or from a compartment of the same row of another tier of the elevator, and a second device for transferring this individual charge into the compartment of the same row of the following tier in the direction of the first tier of the elevator.

In general, the first device for receiving and holding an individual charge in each compartment of the (m−1) tiers of the elevator is retractable to allow the second device to transfer the individual charge into the compartment of the same row of the following tier in the direction of the first tier of the elevator. The second device is on the one hand displaceable in a reciprocating movement between the compartments and, on the other hand, retractable to allow them to revert to their initial position during their return movement.

According to another characteristic of the elevator, all the first devices such as fingers to receive and support an individual charge in each compartment of the (m−1) tiers of the elevator are operated simultaneously, as are the second device such as fingers for transferring the individual charges to the first tier of the elevator.

According to one preferred embodiment of the invention, the m-th tier of the elevator to which all the individual charges of the magazine are directed is the bottom tier, so that all the charges contained in a higher tier of the elevator are simultaneously lowered, tier by tier until they reach the bottom tier. Considering for example a cycle corresponding to the lowering by one tier of a single individual charge, the receiving fingers of the compartment or first compartment, in which the charge is accommodated, are retracted to allow the transfer fingers of the first compartment to lower the charge to the lower compartment or second compartment of the same row of the lower tier. Before the level of this second compartment is reached, the receiving fingers of the second compartment have been lifted to receive the charge, while the transfer fingers of the first compartment begin to retract. When the charge has arrived at the second compartment, it is supported by the receiving fingers of the second compartment, and the transfer fingers of the first compartment are completely retracted. These fingers then rise again, in the retracted position, to their initial position, and, at the end of the return movement, they have pivoted to be able to ensure, upon the next cycle, the lowering of the individual charge that has simultaneously been transferred to the first compartment from the tier above.

According to yet another characteristic of the invention, each first device for inserting individual charges into the elevator from each tier of the magazine includes a rake having n teeth, each of which engages freely inside one of the rows of the tier of the magazine, all the teeth of all the rows of one tier of the magazine being operated simultaneously so as to push individual charges at the same time into the compartments of the elevator.

Thus, the individual charges are transferred in succession from the tier of the magazine located opposite the first tier of the elevator, and when the latter is empty, the individual charges of the next tier are transferred, and so forth.

According to still another characteristic of the invention, the second device for removing the individual charges from the first tier of the elevator includes a conveyor belt of a chute located at one end of the conveyor belt to transfer, one by one, the individual charges to a receiving carrier, and a pushing device that operates in a reciprocating fashion and pushes each individual charge contained in the receiving carrier into the loading carrier, which pushing device operates until a given number of individual charges is received in the loading carrier.

According to a first embodiment, the m-th tier of the elevator, or first tier, is constituted like the (m−1) other higher tiers, and the conveyor belt of the second device removing the charges from the first tier of the elevator is located beneath this first tier.

According to a second embodiment, the m-th tier of the elevator or first tier includes the conveyor belt of the second removal device, which offers the advantage of making the system more compact.

Thus, a predetermined number of individual charges can be stored in the loading carrier, which constitute one batch to be inserted into the chamber of the barrel by appropriate structure, but preferably by an automatic operating arrangement.

Such a storage and feed device has numerous advantages, including:

a maximum individual charge storage capacity, optimum magazine management, variable feed of individual charges at a relatively fast rate, ease of incorporation, particularly into a tank turret, and rapid and automatable reloading capacity.

A system for storing and feeding propellant charges that are intended to be inserted into the chamber of the barrel of a medium- or large-caliber weapon is illustrated in FIG. 1. This system, according to one embodiment of the invention, has a storage part PS and a feed part PA that will be described in succession below.

The storage part PS of the system includes a magazine 1 composed of a frame, of rectangular parallelepipedic shape, delimited for example by vertical risers connected to each other by two front horizontal beams, two rear horizontal beams, and four lateral horizontal beams. These risers and these beams are not shown in detail in Figure I for reasons of simplification.

Magazine 1 has m tiers distributed over its height, each tier being at least delimited by two horizontal lateral bracketing beams 2 (FIG. 4). Each tier is divided into rows delimited by intermediate horizontal beams 3 interposed between the two beams 2. Each intermediate horizontal beam has an I-shaped cross section with a vertical web 4 bordered on each side by two lengthwise shoulders, an upper shoulder 5 and a lower shoulder 6, for example. Each lateral bracketing beam 2 of one tier of magazine 1 also has two lengthwise shoulders, an upper shoulder 5 and a lower shoulder 6 facing corresponding shoulders 5 and 6 of intermediate beam 3 with which it delimits one row. At the lower part of each row, a means is provided for supporting elementary charges CE, this means including for example a roller conveyor 8. Each roller 8*a* of conveyor 8 is mounted freely rotationally on an axis formed by two half-shafts that are supported respectively by the two lower lengthwise shoulders 6 of the two beams, which delimit one row.

Referring to FIGS. I and 2, p individual charges CE are stored, end to end, in each row of the magazine, resting freely on the roller conveyor 8 associated with this row. Each individual charge CE rests laterally on the two upper lengthwise shoulders 5 of the two intermediate beams 3, which delimit the row, the guide shoulders being located essentially at the mid-height of individual charges CE. In this way, it is possible to store m×n×p individual charges CE in magazine 1 of storage part PS.

Feed part PA of the system has a device DT for transferring a predetermined number of individual charges CE from magazine 1 to a loading carrier 10 located, in the example illustrated in FIG. 1, below magazine 1 and offset laterally with respect thereto.

Transfer device DT is constituted by an elevator 11 located opposite the front face 1*a* of magazine 1.

Figure 3:
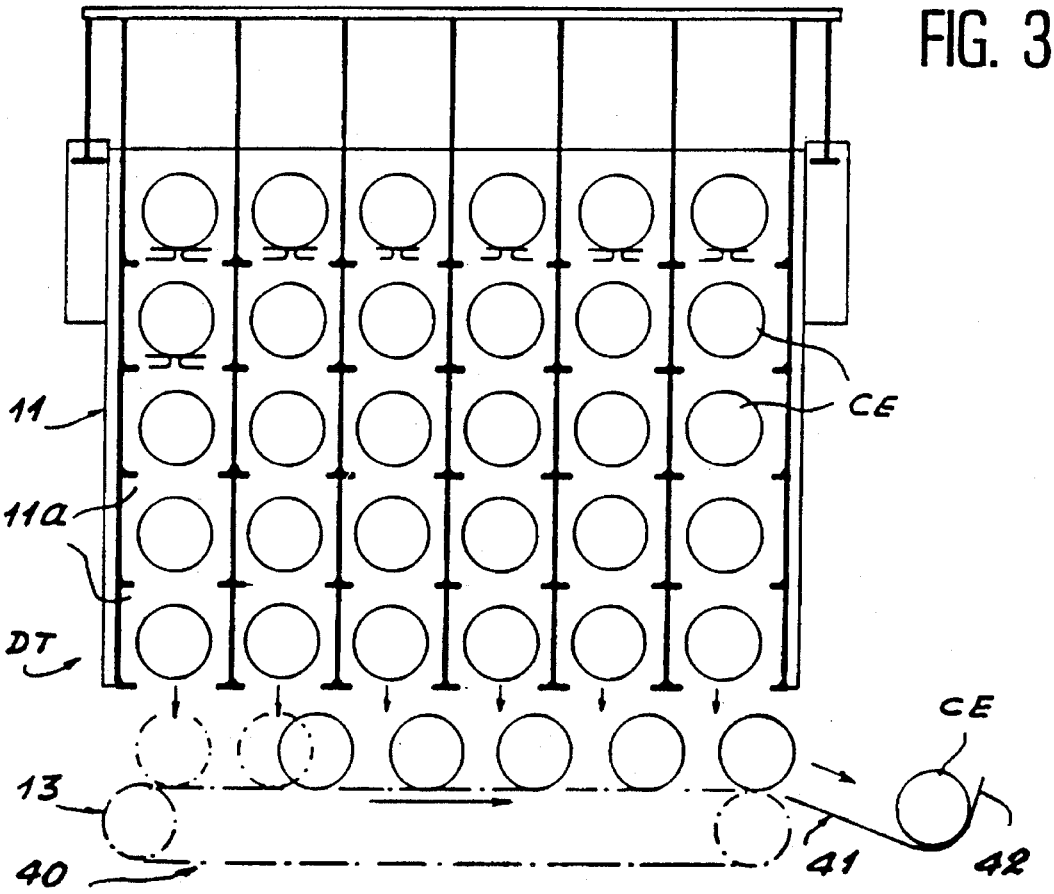
FIG. 3 is a schematic front view of the storage and feed system as shown in FIG. 1.

According to a first embodiment, elevator 11 (FIGS. 1 and 3) has m tiers, just like magazine 1, and each tier is divided into the same number of compartments 11*a* as there are rows contained in one tier of magazine 1. Hence, one compartment 11*a* faces and extends the associated row of magazine 1 at front face 1*a* of the magazine, and it is designed to receive at least one individual charge CE. Overall, the frame of elevator 11 is constituted by the extension of the frame of magazine 1 toward front face 1*a* of magazine 1.

Transfer device DT also has a first device 12 to push individual charges CE into elevator 11 from each tier of magazine 1 and a second device to extract the individual charges CE from elevator 11 when they have reached the first tier or bottom tier thereof, the device then transferring them to loading carrier 10.

With reference to FIG. 5, each compartment 11*a* of one tier of elevator 11 is equipped with first means such as fingers 15 to receive and hold one individual charge CE coming either from the associated row of the same tier of the magazine or from a compartment 11*a* of the same row of the tier above elevator 11 and second means such as fingers 16 to lower this individual charge CE into the compartment in the same row of the tier below in the direction of the first tier of elevator 11.

In the example illustrated in FIG. 5, each compartment 11*a* has four receiving fingers 15 and two transfer fingers 16. The four receiving fingers 15 are disposed in two rows, each row containing two fingers 15 spaced apart, these two fingers 15 being respectively opposite the other two fingers 15 of the other row. One transfer finger 16 is intercalated between two receiving fingers 15 of each row.

In general, each receiving finger 15 is a retractable finger pivotably mounted around a horizontal axis X—X, and each transfer finger 16 is displaceable by a vertical reciprocating movement with an amplitude corresponding essentially to the distance separating two tiers of elevator 11 and retractable, being pivotably mounted around a horizontal axis Y—Y.

In FIG. 6, a receiving finger 15 has been shown in perspective with its pivoting axis X—X formed by two half-shafts 15*a*, the two receiving fingers 15 of a given row being caused to pivot by the rotation of the two half-shafts 15*a* by means of a motor.

Advantageously, receiving fingers 15 of compartments 11*a* of all the tiers of elevator 11 are controlled simultaneously by motor M1 and are connected thereto by a set of mechanical linking devices, not shown.

FIGS. 7 and 8 show one of transfer fingers 16 located in each compartment 11*a* of elevator 11. Each transfer finger 16 is integral with two half-shafts 20, located as extensions of one another and with one on either side of finger 16, Which form the pivoting axis Y—Y of finger 16. The two free ends of half-shafts 20 are supported rotationally by the two vertical risers 21*a* of a rigid frame 21. The two frames 21 of two compartments 11*a* of a given row of two consecutive tiers of elevator 11 are connected to each other by a vertical linking rod 23 that is attached to a horizontal riser 21*b* of each frame 21. Linking rods 23 of frames 21, which support each transfer finger 16 of all the compartments 11*a* of a given row of all the tiers of elevator 11, are aligned with each other, and the sets of linking rods 23 of all the rows of elevator 11 are connected to a control element to ensure a simultaneous downward movement and a simultaneous upward movement of all the transfer fingers 16 of all the tiers of elevator 11. This control element is for example constituted by two jacks 25 (FIG. 1) controlled in synchronism and located one on each side of elevator 11. For this purpose, piston rods 24 of these jacks 25 extend parallel to linking rods 23 and are connected to the upper ends thereof by a rigid support 23*a*.

Each transfer finger 16 of a compartment of elevator 11 is associated with a locking finger 26 integral with a rod 27 extending parallel to rods 23. This locking finger 26 pivots associated receiving finger 16 between a first position, in which it locks finger 16 so that it extends in an essentially horizontal plane to receive an individual charge CE, and a retracted position where it is no longer in contact with receiving finger 16 to allow receiving finger 16 to pivot freely by gravity into a retracted position where it extends in an essentially vertical plane. The two locking fingers 26 of each compartment in a given row of all the tiers of elevator 11 are integral with two vertical rods 27, respectively, and the sets of vertical rods 27 of all the rows of elevator 11 are connected to a control element to ensure simultaneous pivoting movements of all the transfer fingers 16 during one simultaneous downward movement and one simultaneous return movement of all the locking fingers 26 of all the tiers of elevator 11. This control element is for example made of two jacks 30 (FIG. 1) controlled in synchronism and located on each side of elevator 11. For this purpose, piston rods 28 of these jacks 30 extend parallel to rods 27 and are connected to the upper ends thereof by a rigid support 28*a*.

The first device 12 for inserting individual charges CE into elevator 11 from each tier of magazine 1 is constituted by a rake having n teeth 31, each of which penetrates freely one of the n rows of the tier of magazine 1. The n teeth 31 are integral with a bar 32 that extends transversely above the rows of the tier of magazine 1. The two ends of bar 32 terminate in two nuts 33 threaded on two lateral threaded rods 34, each of which extends between front face 1*a* and rear face 1*b* of magazine 1. Advantageously, all the threaded rods 34 of all the tiers of magazine 1 are connected at the rear face of the latter to mechanical coupling devices 35, themselves connected to a single motor M2 that, as it turns, controls the insertion device 12 of the top tier of magazine 1 to push simultaneously n individual charges CE into the compartments 11*a* of the top tier of elevator 11. When this tier is empty, motor M2 operates insection device 12 of the next lower tier, and so forth down to the first tier of magazine 1.

The second device 13, which supplements transfer device DT to extract individual charges CE from the first tier of elevator 11 and transfer them to loading carrier 10, comprises a conveyor belt 40 located beneath and opposite the first tier of elevator 11 to receive individual charges CE that are lowered by means. of transfer fingers 16 of the first tier of elevator 11. Conveyor belt 40 is driven by a motor M3 and cooperates, at one end, with a chute 41 into which one by one, the individual charges CE are fed to a receiving carrier 42 aligned axially with loading carrier 10.

Second device 13 is supplemented by a pushing device 45 located behind receiving carrier 42 relative to loading carrier 10. Pushing device 45 is constituted by a jack 46 of which piston rod 47 terminates in a head 48 that is designed to push an individual charge CE contained in receiving carrier 42 to transfer it to carrier 10. Piston rod 47 supports a lateral shutter 49 mounted coaxially with the body of jack 46 to close the passage cross section of chute 41 when an individual charge CE is pushed, to prevent a new charge CE from dropping into carrier 42. Shutter 49, when it returns, once more opens the passage cross section of chute 41 and positions itself along and outside the body of jack 46. Thus, to form a batch of x individual charges CE in carrier 10, pushing device 45 will be activated x times.

Figures 9A, 9B:
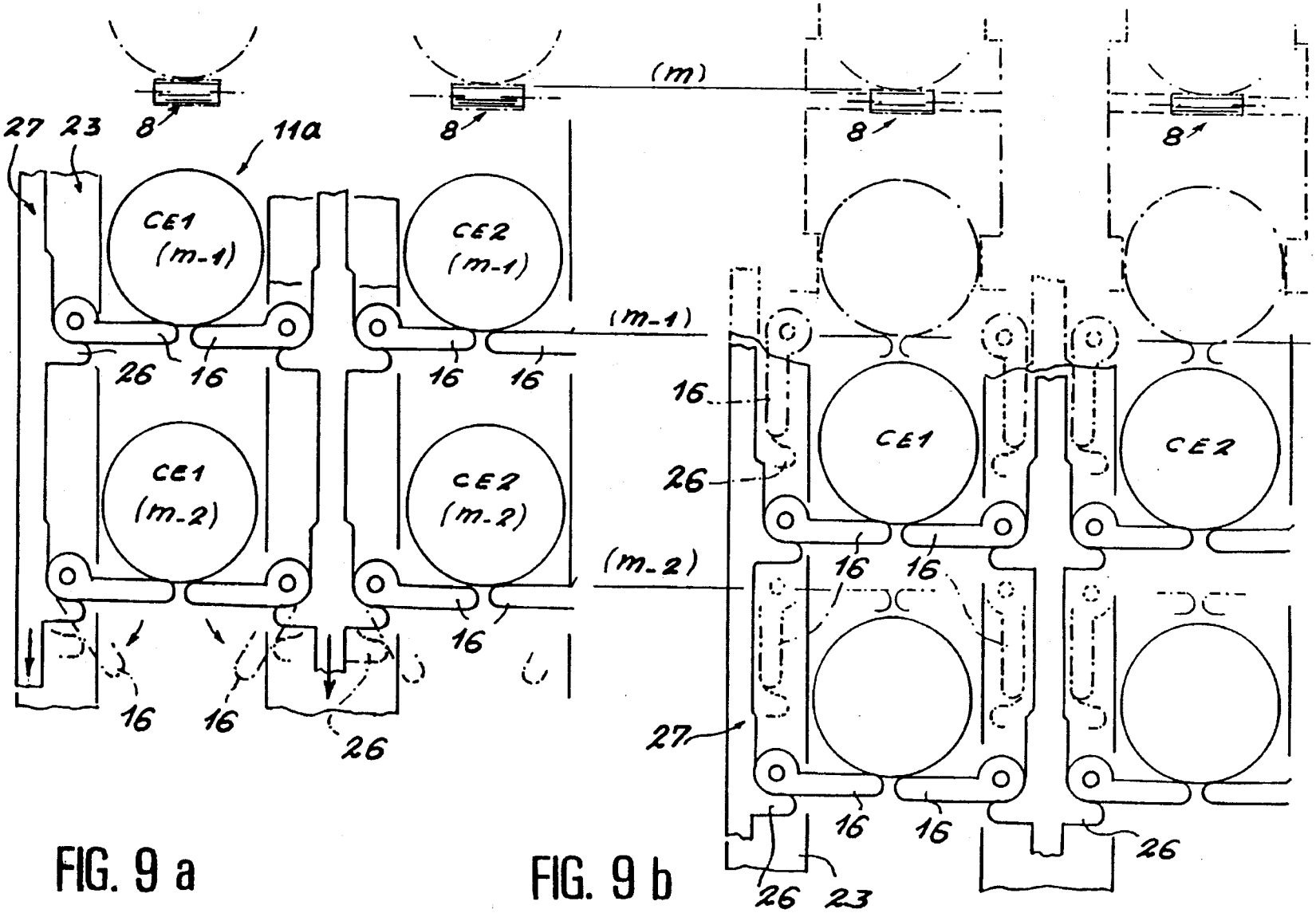

The operation of the system according to the invention will now be described in detail with reference in particular to FIGS. 9*a* and 9*b*, assuming to begin with that:

- all the tiers of magazine 1 are filled with individual charges CE, as well as all the tiers of elevator 11, which in a certain way increases the storage capacity of magazine 1 by a number m×n charges, or a total capacity of (m×n×p)+(m×n) charges;
- each of the n teeth 31 in each first insertion device 12 of all the tiers of magazine 1 rests against the one of the n individual charges CE that is located at the back of each of the n rows of the tiers;
- the receiving fingers 15 and transfer fingers 16 of each compartment 11*a* of elevator 11 support an individual charge CE, each of transfer fingers 16 then being locked in position by a locking finger 26; and
- for example four individual charges CE are transferred to loading carrier 10 to constitute propellant charge to be then routed to the barrel chamber.

Elevator 11 is activated to deposit simultaneously n individual charges CE on conveyor belt 40, these n charges coming from the compartments of the first tier of elevator 11.

A first operation includes activating motor M1 to cause receiving fingers 15 of all the compartments 11*a* of the elevator to pivot simultaneously downward by 90° so that they assume a retracted position. The individual charges CE of all the compartments 11*a* of elevator 11 are then supported only by transfer fingers 16, as shown schematically in FIG. 9*a* considering for example tiers (m–1) and (m–2) of elevator 11 where two individual charges CE1 and CE2 located in two compartments of tier (m–1) of elevator 11 are shown.

A second operation includes lowering by one tier, all the individual charges CE contained in one tier of elevator 11. For this purpose, jacks 25 and 30 are activated at the same time so as to move simultaneously, in a descending movement, all the rods 23 that support transfer fingers 16 of each compartment 11*a* and all the rods 27 that support locking fingers 26 of transfer fingers 16. FIG. 9*b* shows the aforesaid individual charges CE1 and CE2 in an intermediate position during their descent from tier (m–1) to tier (m–2) of elevator 11. With continued reference to FIG. 9*a*, both individual charges CE1 and CE2 have reached their respective compartments of tier (m–2) of elevator 11. At this stage, it is important to note that piston rods 24 of jacks 25 have already reached their maximum travel, which means that rods 23 that move transfer fingers 16 have been immobilized. On the other hand, piston rods 28 of jacks 30 have still not reached their maximum travel, which means that rods 27 that support locking fingers 26 of receiving fingers 16 continue their descending movement. Under these conditions, locking fingers 26 gradually release receiving fingers 16, which can then pivot freely by gravity to assume a retracted position, whereupon individual charges CE1 and CE2 are received by receiving fingers 15 of tier (m–2) of elevator 11 which have resumed their initial position during the descending movement of individual charges CE1 and CE2 due to the activation of motor M1 in the rotational direction opposite that which allowed these fingers 15 to retract.

A third operation includes causing transfer fingers 16 to return to their respective compartments 11*a*. For this purpose, jacks 25 and 30 are activated at the same time to raise simultaneously all the rods 23 that support transfer fingers 16 and all of rods 27 that support associated locking fingers 26. During this rising movement, transfer fingers 16 remain in the retracted position, as shown in dashed lines in FIG. 9*b*. As before, rods 23 are immobilized when transfer fingers 16 have reached their respective tiers of elevator 11. 0n the other hand, rods 27 that support locking fingers 26 are still not immobilized, which has the effect of bringing these locking fingers 26 into contact with associated transfer fingers 16 in order to cause them to pivot back into their initial positions so that they can once more lower a new individual charge.

Considering the first tier of elevator 11, the operation of lowering the individual charges CE contained in this tier has had the result of simultaneously depositing n individual charges on conveyor belt 40. The individual charges CE are conveyed by conveyor belt 40 in the direction of chute 41 so that individual charges CE drop one by one into receiving carrier 42. As soon as the first individual charge CE is received in carrier 42, pushing device 45 is activated to push this individual charge CE forward in loading carrier 10 over a distance corresponding essentially to the length of individual charge CE. During the movement of piston rod 47, its head 48 comes to rest against individual charge CE and pushes it, while lateral shutter 49 integral with piston rod 47 closes the passage cross section of chute 41 to prevent a new individual charge CE from dropping into receiving carrier 42. When piston rod 47 has returned to its initial position, a new individual charge CE is dropped into carrier 42, and the same process is repeated until four individual charges CE are positioned in loading carrier 10. These four individual charges CE then constitute a batch that can be routed to the barrel chamber by means not shown.

It may be advantageou,s to provide several loading carriers 10 in order to load into one carrier the number of individual charges that constitute one batch, while the batch contained in another carrier is being loaded into the barrel chamber, which allows simultaneous loading to increase the firing rate of the weapon. In this case, a carrier support device must be provided, associated with a control device to successively position each carrier 10 in the extension of fixed receiving carrier 42, these devices being defined as a function of the system used to load the chamber of the weapon.

When the n individual charges CE of the first tier of elevator 11 have been received by conveyor belt 40, all the compartments 11*a* of the top tier of elevator 11 are empty. First insertion device 12 of the top tier of magazine 1 is then activated by means of motor M2 in order simultaneously to push n charges from the top tier of magazine 1 by means of teeth 31 in order to introduce n charges into the n compartments 11*a* of elevator 11, and so forth.

All the aforesaid operations are synchronized by a control unit (not shown) so that compartments 11*a* of all the tiers of elevator 11 always contain individual charges CE as long as the top tier of magazine 1 is not empty, and so that compartments 11*a* of the (m–1) tiers of elevator 11 contain individual charges CE when the top tier of magazine 1 is empty, and so forth.

According to a second embodiment of the invention, elevator 11 also has as many tiers as magazine 1, but the first tier or bottom tier to which the individual charges CE are directed is not constituted like the (n–1) tiers above.

This first tier is constituted by conveyor belt 40, which offers the advantage of rendering the system more compact without reducing its storage capacity. According to the first embodiment, (m×n×p) charges can be stored in magazine 1 and (m×n) charges in elevator 11, without taking into account the conveyor belt located outside the elevator, and according to the second embodiment, the same number of charges can be stored taking into account conveyor belt 40, which is built into elevator 11.

According to one particular embodiment of the invention, magazine 1 and elevator 11 can be dimensioned so that they operate on a number of individual charges CE, which is a multiple of 6 for example.

Of course, the invention is not confined to the above embodiment, which was provided only as an example. In particular, variations may also be envisaged for the conveyor belt that for example can be replaced by an inclined plane over which the individual charges roll, pushed into the chute by a head integral with a jack rod, the head being advantageously guidable translationally by at least one pin moving in a groove of the inclined plane. Finally, an elevator may be contemplated that ensures the lowering of the individual charges down to a loading carrier located beneath the elevator, but the operation could be reversed.

What is claimed is:

1. A system for storing and feeding propellant charges having a storage part comprising a magazine and a feed part comprising a device for transferring the charges from the magazine to a loading carrier, said magazine being divided into m tiers each divided into n rows, each containing p of said propellank charges, said transfer device comprising:

an elevator located opposite a front face of said magazine, said elevator comprising compartments adapted to receive individual charges contained in said magazine wherein said compartments are configured to transport said charges to a first tier of said elevator, a first device engaging said charges, said first device inserting individual charges into said elevator from each tier of said magazine, and a second device disposed adjacent the first tier of said elevator and adapted to receive individual charges from the first tier of said elevator, said second device transporting said charges to said loading carrier.

2. A system according to claim 1, wherein said elevator comprises m tiers, and wherein each of at least (m−1) of said tiers is divided into the same number of compartments as there are rows in one tier of said magazine, each compartment being located opposite one row of said magazine and being shaped to receive at least one individual charge.

3. A system according to claim 2, wherein each compartment of the (m−1) tiers of said elevator comprises first means for receiving and holding one individual charge, and second means for transferring said one individual charge into another compartment of the same row of the following tier in the direction of the first tier of said elevator.

4. A system according to claim 3, wherein said first means is retractable to allow said second means to transfer said one individual charge into said another compartment of the same row of the following tier in the direction of the first tier of said elevator.

5. A system according to claim 3, wherein said second means is reciprocatingly displaceable between said compartments.

6. A system according to claim 3, wherein said first means comprises at least one finger pivotably retractable by a driving means from a first position to receive and support an individual charge and a second retracted position to allow said individual charge to be transferred in the direction of the first tier of said elevator.

7. A system according to claim 6, wherein said finger is integral with a shaft reversibly rotatably driven by said driving means, said driving means comprising a motor.

8. A system according to claim 7, wherein said fingers are pivoted simultaneously by said motor.

9. A system according to claim 5, wherein said second means comprises:

at least one transfer finger pivotably mounted on a first support, driving means for moving said first support in a reciprocating vertical movement with an amplitude corresponding essentially to a distance separating two tiers of said elevator, at least one locking finger integral with a second support, and driving means for moving said second support simultaneously with said first support to maintain said transfer finger in a first orientation supporting said individual charge and to allow said transfer finger to retract to a second orientation when said second support reaches a terminal position and for moving said second support to allow said transfer finger to resume its first orientation at the end of the return movement of said second support.

10. A system according to claim 9, wherein each of the transfer fingers comprises a first vertical rod and wherein said second supports of said locking fingers comprise a second vertical rod.

11. A system according to claim 10, wherein said first rods are controlled by at least one first jack having a piston rod connected to said first rods.

12. A system according to claim 11, wherein said second rods are controlled by at least one second jack having a piston rod connected to said second rods.

13. A system according to claim 1, wherein the first device comprises n teeth, each of said teeth engaging a charge inside one of the n rows of the tier of said magazine and being operated simultaneously to push n individual charges into the n compartments of said elevator.

14. A system according to claim 13, wherein said n teeth are integral with a bar extending transversely above the rows of the tier of said magazine, and wherein opposite lateral ends of said bar terminate in two nuts threaded on two lateral threaded rods, each of said threaded rods extending between said front face and a rear face of said magazine.

15. A system according to claim 14, wherein said two threaded rods are driven rotationally by a drive element, and wherein each of the rods of the (m−1) tiers of said magazine is controlled in succession by said drive element.

16. A system according to claim 1, wherein the second device comprises a conveyor belt and a chute disposed at an end of said conveyor belt, said chute transferring said individual charges one by one to a receiving carrier, the system further comprising a pushing device for pushing each individual charge to said loading carrier.

17. A system according to claim 16, wherein said elevator comprises m tiers and wherein each of the m tiers of said elevator is substantially identical and divided into said compartments opposite each of the rows of said magazine, said conveyor belt being located below the first tier of said elevator.

18. A system according to claim 16, wherein said bottom tier of said elevator comprises said conveyor belt.

19. A system according to claim 16, wherein said pushing device comprises a jack having a piston rod including a head for resting against an individual charge received in said receiving carrier and for pushing said charge into said loading carrier over a distance corresponding essentially to the length of said individual charge.

20. A system according to claim 19, wherein said piston rod of said jack supports a lateral shutter mounted coaxially with said piston rod, said shutter closing a passage cross section of said chute upon movement of said piston rod of said jack.

21. A system for storing and feeding propellant charges, said propellant charges being fed to a loading carrier, the system comprising:

storing means comprising a plurality of compartments for storing said propellant charges; and main transfer means for transferring said propellant charges from said storing means to said loading carrier;

wherein said main transfer means comprises an elevator having an upper tier, at least one middle tier, and a bottom tier, said elevator being disposed adjacent said storing means and comprising intermediate transfer means for transferring said propellant charges from said upper tier and said at least one middle tier to said lower tier, and final transfer means for transferring said propellant charges from said lower tier to said loading carrier.

22. A system according to claim 21, wherein said storing means comprises an upper tier, at least one middle tier, and a bottom tier corresponding to the tiers of said elevator, said main transfer means further comprising initial transfer means disposed in said storing means for transferring said propellant charges stored in said upper tier, said at least one middle tier, and said bottom tier of said storing means, respectively to said upper tier, said at least one middle tier, and said bottom tier of said elevator.

23. A system according to claim 22, wherein said initial transfer means comprises:

a bar disposed in each of said upper tier, said at least one middle tier, and said bottom tier of said storing means, said bar comprising a plurality of teeth, at least one of said teeth extending into each of said compartments, and moving means for moving said bar from a position in said storing means opposite said elevator to a position in said storing means adjacent said elevator.

24. A system according to claim 23, wherein said moving means comprises two threaded rods disposed in each of said upper tier, said at least one middle tier, and said bottom tier of said storing means, said threaded rods extending from said position in said storing means opposite said elevator to said position in said storing means adjacent said elevator, wherein said bar is engaged with opposite ends of said threaded rods, and wherein said moving means further comprises a drive unit for rotating said threaded rods.

25. A system according to claim 21, wherein said intermediate transfer means comprises at least one first pivotable finger and at least one second pivotable finger, said first finger being pivotable between an extended position and a retracted position by a motor, said second finger being pivotable between an extended position and a retracted position and vertically movable between two vertically adjacent tiers in said elevator from an upper position to a lower position, said intermediate transfer means further comprising a displacing rod engaged with said second finger and vertically movable with said second finger from a top position, vertically higher than said upper position to a low position, vertically lower than said lower position, wherein said displacing rod urges said second finger toward said extended position in said top position and releases said second finger in said low position so that said second finger is pivoted to said extended position.

26. A system according to claim 21, wherein said final transfer means comprises:

a conveyor belt disposed below said bottom tier of said elevator, said conveyor belt conveying said propellant charges to a receiving carrier, a conveyor driver for driving said conveyor belt, and pushing means for pushing said propellant charges from said receiving carrier to said loading carrier.

* * * * *